US006202517B1

(12) United States Patent
Dolan

(10) Patent No.: US 6,202,517 B1
(45) Date of Patent: Mar. 20, 2001

(54) SELF OPENING LINE OF PLIERS

(76) Inventor: Michael Dolan, 23 Rebecca La., Hattiesburg, MS (US) 39402

( * ) Notice: Subject to any disclaimer, the term of this patent is extended or adjusted under 35 U.S.C. 154(b) by 0 days.

(21) Appl. No.: 09/374,908

(22) Filed: Aug. 13, 1999

(51) Int. Cl.[7] ..... B25B 7/02
(52) U.S. Cl. ..... 81/427; 81/418
(58) Field of Search ..... 81/418, 420, 421, 81/424.5, 427; 7/125, 126, 166

(56) References Cited

U.S. PATENT DOCUMENTS

| | | | | |
|---|---|---|---|---|
| 133,383 | * | 11/1872 | Ober | 7/137 X |
| 334,862 | * | 1/1886 | Harmon | 7/127 |
| 445,972 | * | 2/1891 | Caldwell | 7/128 |
| 525,460 | | 9/1894 | House . | |
| 1,664,081 | * | 3/1928 | Means | 7/127 X |
| 3,398,746 | * | 8/1968 | Abramson | 81/427 X |
| 4,206,663 | * | 6/1980 | Pace | 81/418 X |
| 4,244,067 | * | 1/1981 | Rowe | 7/127 X |
| 5,019,092 | * | 5/1991 | Klintmalm | 81/418 X |
| 5,280,659 | | 1/1994 | Park . | |
| 5,327,602 | | 7/1994 | Stenger . | |
| 5,497,522 | * | 3/1996 | Chen | 7/128 |
| 5,546,661 | | 8/1996 | Yang . | |
| 5,575,029 | | 11/1996 | Simpson . | |

* cited by examiner

*Primary Examiner*—David A. Scherbel
*Assistant Examiner*—Anthony Ojini
(74) *Attorney, Agent, or Firm*—Michael I Kroll

(57) ABSTRACT

The present invention 10 discloses a spring system 20 and a latch system 18 for either maintaining a set of pliers in an open position or a closed position. The spring system 20 operates by having a spring 32 disposed on a pair of studs 42 located in the trough 44 of an outwardly curved portion 40 of the handles 28, 30 of the pliers. The latch system 18 comprises a pair of tongue-like members 48, 50 and a wire loop member 58 which hooks onto a notch 49 in one of the tongue-like members 50. The spring system 20 normally maintains the pliers in an open position when no load is applied to handles 28, 30.

3 Claims, 14 Drawing Sheets

PLIERS CLOSED

PLIERS OPENED

ELECTRICIAN'S PLIERS-CLOSED

ELECTRICIAN'S PLIERS-OPENED

PLIERS CLOSED

PLIERS OPENED

NEEDLE NOSE PLIERS CLOSED

NEEDLE NOSE PLIERS OPEN

SELF OPENING LINE OF PLIERS

BACKGROUND OF THE INVENTION

1. Field of the Invention

The present invention relates generally to pliers and more specifically to variously shaped hand tools having pivoting jaws which are designed to hold, bend, twist or cut, such as, pliers, linesman pliers, wire cutters, and needle nose pliers, hereinafter referred to as pliers. The pliers have specially designed handles having an outwardly projecting recessed curve below the pivot point having oppositely opposed studs at the trough of the recessed curve projecting inwardly whereupon is mounted a coiled spring, held on by nubs located on studs, being of such a compressed state as to cause the handle members, under a no load condition, to naturally pivot to a fully open position. Further situated at the apex of the curved recesses are oppositely opposed inwardly projecting tongue-like members. The first tongue-like member has a notch and the second tongue-like member has an aperture having a rivet passing therethrough having a wire member wrapped around each end of the rivet forming an inwardly projecting rotating loop for engaging the notch of the first tongue-like member thereby providing means closure retention means for said spring tensioned handles. In operation of said pliers the notch is formed in such a manner that by lightly compressing the handles together and at the same time with your thumb manually pulling down the wire loop causing it to disengage from the notch thereby forming self-opening pliers. The pliers closure means is engaged by compressing the handles until the loop wire member can be manually rotated to engage the notch of the first-tongue-like member.

In addition said pliers can have a solid leverage spanner fixedly attached or molded into one jaw providing leverage means for the removal of nails and staples Further said pliers can have a hammer-like claw formed at the distal end of said handle providing means for using the pliers as a pry bar. The handles are also covered by an electrically non-conductive material, which also assists in gripping the tool.

2. Description of the Prior Art

There are other plier combination tool devices designed for multipurpose use. Typical of these is U.S. Pat. No. 5,546,661 issued to Yang on Aug. 20, 1996.

Another patent was issued to House, on Sep. 4, 1894 as U.S. Pat. No. 525,460. Yet another U.S. Pat. No. 5,327,602 was issued to Stenger on Jul. 12, 1994 and still yet another was issued on Jan. 25, 1994 to Park as U.S. Pat. No. 5,280,659.

Another patent was issued to Simpson on Nov. 19, 1996 as U.S. Pat. No. 5,575,029.

U.S. Pat. No. 5,546,661

Inventor: Chen-Jeng Yang

Issued: Aug. 20, 1996

A pair of shears has a fixed blade, a fixed handle connecting the fixed blade, and a driving handle connecting the driving blade, a spring between two handles, a pin on the crisscross portion between two blades, and a switch button on the outer side of the fixed handle. The first threaded hole and the first positioning post are formed on the front of the blade. The second threaded hole and the second positioning post are formed on the inner side of the fixed handle. A cutting device such as a saw blade and a sickle is disposed in front of the fixed blade. A through hole and a positioning hole are formed on the rear of the cutting device. The first positioning post inserts in the positioning hole. A screw passes through the through hole and the first threaded hole to fasten the cutting device.

U.S. Pat. No. 525,460

Inventor: James A. House

Issued: Sep. 4, 1894

A new and useful combined belt-punch, belt-cutter, and pliers, of which the following is a specification. A combination tool in which a round-belt cutter, and punch are combined with pliers-jaws by which the tool is particularly adapted to be used in connection with sewing machines, and other apparatus in which round or cord-belts are used and which as they become stretched from use, have to be disconnected at their ends, a piece cut off, and then punched for reconnection.

U.S. Pat. No. 5,327,602

Inventor: Tracy K. Stenger

Issued: Jul. 12, 1994

A spanner wrench is clamped to one component of a conventional pair of pliers and is prevented from turning relative to that component by the same pivot element which pivotably connects the two plier components to one another U.S. Pat. No. 5,280,659

Inventor: No K. Park

Issued: Jan. 25, 1994

A multipurpose tool comprising a pair of movable members which are hinged together and includes four working stations each of which has a pair of working edges. The pair of working edges has different working function. The multipurpose tool of the present disclosure is composed of a material of good wear resistance, toughness and hardness and has a disadvantage in that all of the manual works, for example, stripping of an electric wire, cutting of wire, preventing the rotation of pipes, pounding, scissoring of a thin metal plate, loosening or tightening of screws and nuts, can be done only by the multipurpose tool of the present invention.

U.S. Pat. No. 5,575,029

Inventor: Dave Simpson

Issued: Nov. 19, 1996

A combination hand tool comprising a first and second pivoting pin. The single combination hand tool comprises means for performing multiple functions. The combination hand tool comprises a hammer head and claw, a first set of plier gripper jaws, a wire stripper and a pipe reamer.

While these multipurpose plier tools may be suitable for the purposes for which they were designed, they would not be as suitable for the purposes of the present invention. The pliers changes were purposely designed to do the best job in situations, as hereinafter described. In applications where repetitive opening and closing is required, (as in a cutting situation) it is extremely convenient that these tools self open. The design of the handles in general, makes gripping more comfortable, or in fact are ergonomically designed.

SUMMARY OF THE PRESENT INVENTION

The present invention discloses a spring system and a latch system for either maintaining various types of pliers in an open position or a closed position. The spring system operates by having a spring disposed on a pair of studs located in the trough of an outwardly curved portion of the handles. The latch system comprises a pair of tongue-like members and a wire loop member which hooks onto a notch in one of the tongue-like members. The spring system normally maintains the pliers in an open position when no load is applied to handles.

A primary object of the present invention is to provide a self opening pliers that open by a unique handle, latch and spring system with variations in size and style.

Another object of the present invention is to provide a self opening pliers having specially designed handles having an outwardly projecting recessed curve below the pivot point having oppositely opposed studs at the trough of the recessed curve projecting inwardly whereupon is mounted a coiled spring, which is held on by nubs on the studs, being of such a compressed state as to cause the handle members, under a no load condition, to naturally pivot to a fully open position.

Yet another object of the present invention is to provide a self opening pliers having tongue-like members situated at the apex of the handles curved recess which are oppositely opposed and inwardly projecting having a notch in one member and a rotative rivet in the other having a wire member wrapped around each end of the rivet forming an inwardly projecting rotating loop for engaging the notch of the first tongue-like member thereby providing closure means for the spring tensioned handles.

Still yet another object of the present invention is to provide a self opening pliers which open by lightly compressing the handles together and at the same time with your thumb disengaging the wire loop member from the notched member.

Another object of the present invention is to provide a self opening pliers having a hammer-like claw formed at the distal end of said handle providing means for using the pliers as a pry bar.

Yet another object of the present invention is to provide a self opening pliers having closure means which is engaged by compressing the handles until the loop wire member can be manually rotated to engage the notch on the opposing tongue-like member.

Still yet another object of the present invention is to provide a self opening pliers having a solid leverage piece spanner fixedly attached or molded into one jaw providing leverage means for the removal of nails and staples.

Another object of the present invention is to provide self opening pliers having the handles covered by an electrically non-conductive material which also assists in gripping the tool.

Additional objects of the present invention will appear as the description proceeds.

The present invention overcomes the shortcomings of the prior art by providing hand tools having pivoting jaws having specially designed handles having an outwardly projecting recessed curve below the pivot point having oppositely opposed studs with nubs at the trough of the recessed curve projecting inwardly having a coiled spring mounted therebetween. Also having tongue-like members situated at the apex of the curved recesses oppositely opposed and inwardly projecting providing closure securement means for said hand tools. The first tongue-like member having a notch and the second tongue-like member having an aperture having a rivet passing therethrough having a wire member wrapped around each end of the rivet forming an inwardly projecting rotating loop for engaging the notch of the first tongue-like member. Also, said hand-tools can have a solid piece fixedly attached or molded onto one jaw providing leverage means for the removal of nails and staples, and a hammer-like claw formed at the distal end of said handle providing means for using the hand tool as a pry bar. The handles are also covered by an electrically non-conductive material which also assists in gripping the tool.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 1 also illustrates the multipurpose solid leverage piece, to remove any number of stuck, rusted, or unwanted nails or staples. Also shown are the grip like teeth, used as a conventional plier. The latch system is shown open. The spring system, squeezed together by illustrated hand closing the jaw. When the user releases hand pressure on said invention, the jaw is forced open by the spring system.

DESCRIPTION OF THE PREFERRED EMBODIMENT(S)

In order that the invention may be more fully understood, it will now be described, by way of example, with reference to the accompanying drawings in which FIGS. 1 through 14 illustrate the present invention being self-opening pliers.

Figure 1:
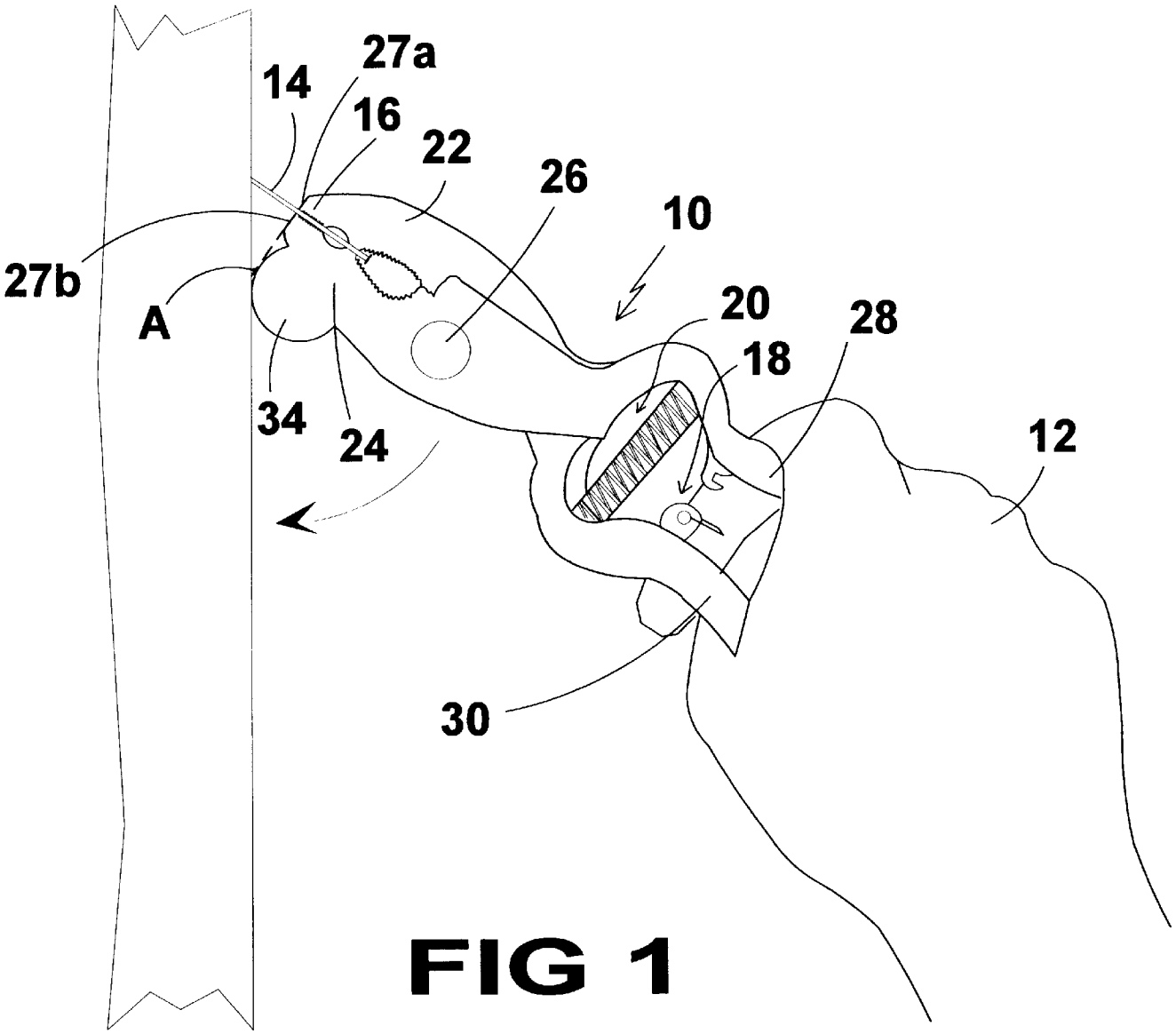
FIG. 1 is an illustration of the present invention depicting the self opening pliers in use. The combination tool comprises of a pair of self opening pliers.

Turning to FIG. 1, shown therein is an illustration of the present invention 10 depicting the self-opening pliers in use in the hand 12 of a user. The combination tool comprises a set of self-opening pliers. FIG. 1 also illustrates the multipurpose solid means for leverage piece 34 being an enlarged member on the back of a jaw 24, to remove any number of stuck, rusted, or unwanted nails or staples 14. Also shown are the grip like teeth 16, used as a conventional plier. The latch or lock system 18 is shown open. The spring system 20, squeezed together by illustrated hand 12 closing the jaw members 22, 24. When the user releases hand 12 pressure on the invention 10, the jaws 22, 24 are forced open by the spring system 20. Pivot 26 and handles 28, 30 are also shown.

As illustrated, jaws 22 and 24 have aligned flat ends 27*a* and 27*b*, and leverage piece 34 is substantially circular with flat ends 27*a* and 27*b* aligned with a tangent to leverage piece at A. When prying a nail, for example, pliers 10 rolls on leverage piece 34.

Figure 2:
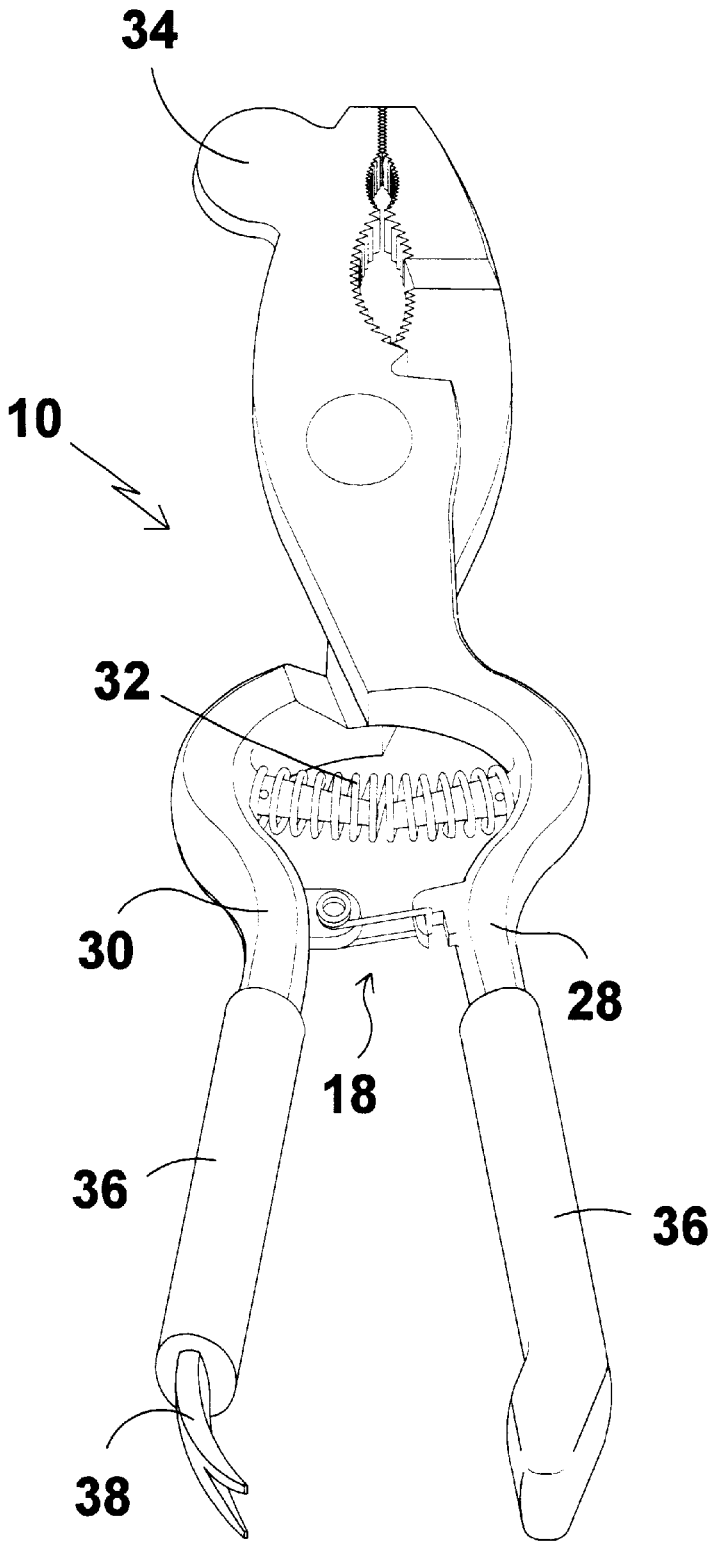
FIG. 2 is a perspective view of said invention, showing the self opening plier in lock position. The spring is now in a compressed stage and the latch in lock position. Also shown is the solid leverage piece for removing nails and staples. The handles are shown with their rubber like material jacket, to provide comfort to the hand and protect from possible electric contact. At the end of one handle is illustrated a claw like device for multipurpose.

Turning to FIG. 2, shown therein is a perspective view of the present invention 10, showing the self-opening plier in locked position. The spring 32 is now in a compressed stage and the latch 18 in locked position. Also shown is the solid leverage piece 34 for removing nails and staples. The handles 28, 30 are shown with their rubber like material jacket 36, to provide comfort to the hand and protect and insulate from possible electric shock. At the end of one handle 30 is illustrated a claw like device 38 for multipurposes.

Figure 3:
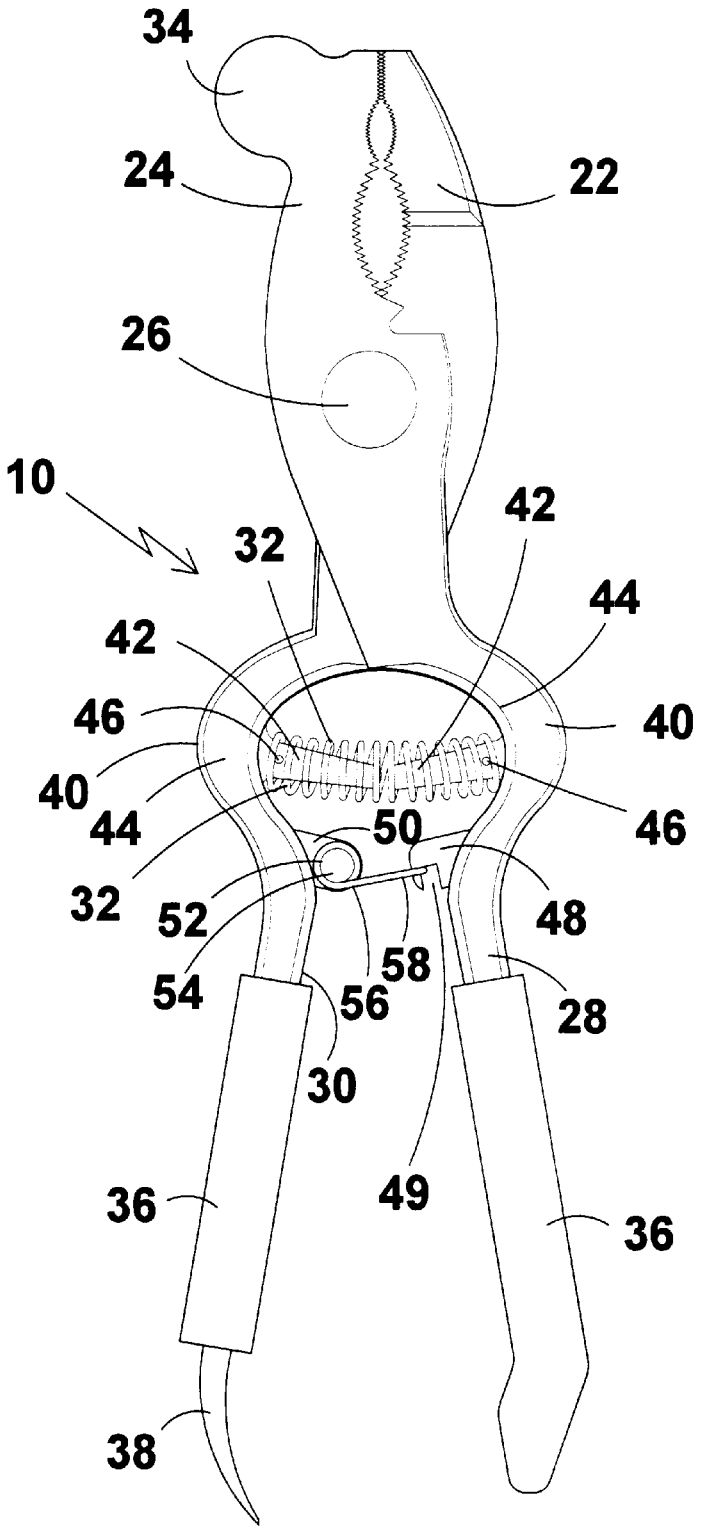
FIG. 3 is an orthographic view of said invention. The pliers are shown in the lock position showing the spring compressed and plier jaw closed. It also illustrates the solid leverage piece, the rubber like insulating material of the handle jacket and a claw device.

Turning to FIG. 3, shown therein is an orthographic view of the present invention 10. The pliers 10 are shown in the locked position showing the spring 32 compressed and plier jaws 22, 24 closed. It also illustrates the solid leverage piece 34, the rubber like insulating material of the handle jacket 36 and a claw device 38. The pliers 10 have specially designed handles 28, 30 each having an outwardly projecting curved portion 40 below the pivot point 26 having oppositely opposed studs 42 at the trough 44 of the curved portion 40, the studs 42 projecting inwardly whereupon is mounted a coiled spring 32 providing means for outwardly biasing the handles 28, 30 held on by outwardly protruding nubs 46 located on studs 42 near their base, the spring 32 being of such compressed state as to cause the handle members 28, 30 under a no load condition, to naturally pivot to a fully open position. Further situated near the bottom of the curved portions 40 are oppositely opposed inwardly projecting tongue-like members 48 and 50. The first tongue-like member 48 has a notch 49 and the second tongue-like member 50 has an aperture 52 having a rivet 54 passing therethrough having a wire member 56 wrapped around each end of the rivet 54 forming an inwardly projecting rotating loop 58 for engaging the notch 49 of the first tongue-like member 48 thereby providing means for closure and retention means for the spring 32 tensioned handles 28, 30. In operation of the pliers 10, the notch 49 is formed in such a manner that by lightly compressing the handles 28, 30 together and at the same time with the thumb of the user manually pulling down the wire loop 58 causing it to disengage from the notch 49 thereby forming self-opening pliers. The pliers closure means is engaged by compressing the handles 28, 30 until the loop wire member 58 can be manually rotated to engage the notch 49 of the first tongue-like member 48.

In addition, the pliers can have a solid leverage portion 34 fixedly attached or molded into one jaw 24 providing leverage means for the removal of nails and staples. Further, the pliers can have a hammer-like claw 38 formed at the distal end of the handle 30 providing means for using the pliers as a pry bar. The handles 28, 30 are also covered by an electrically non-conductive material 36 which also assists in gripping the tool.

Figure 4:
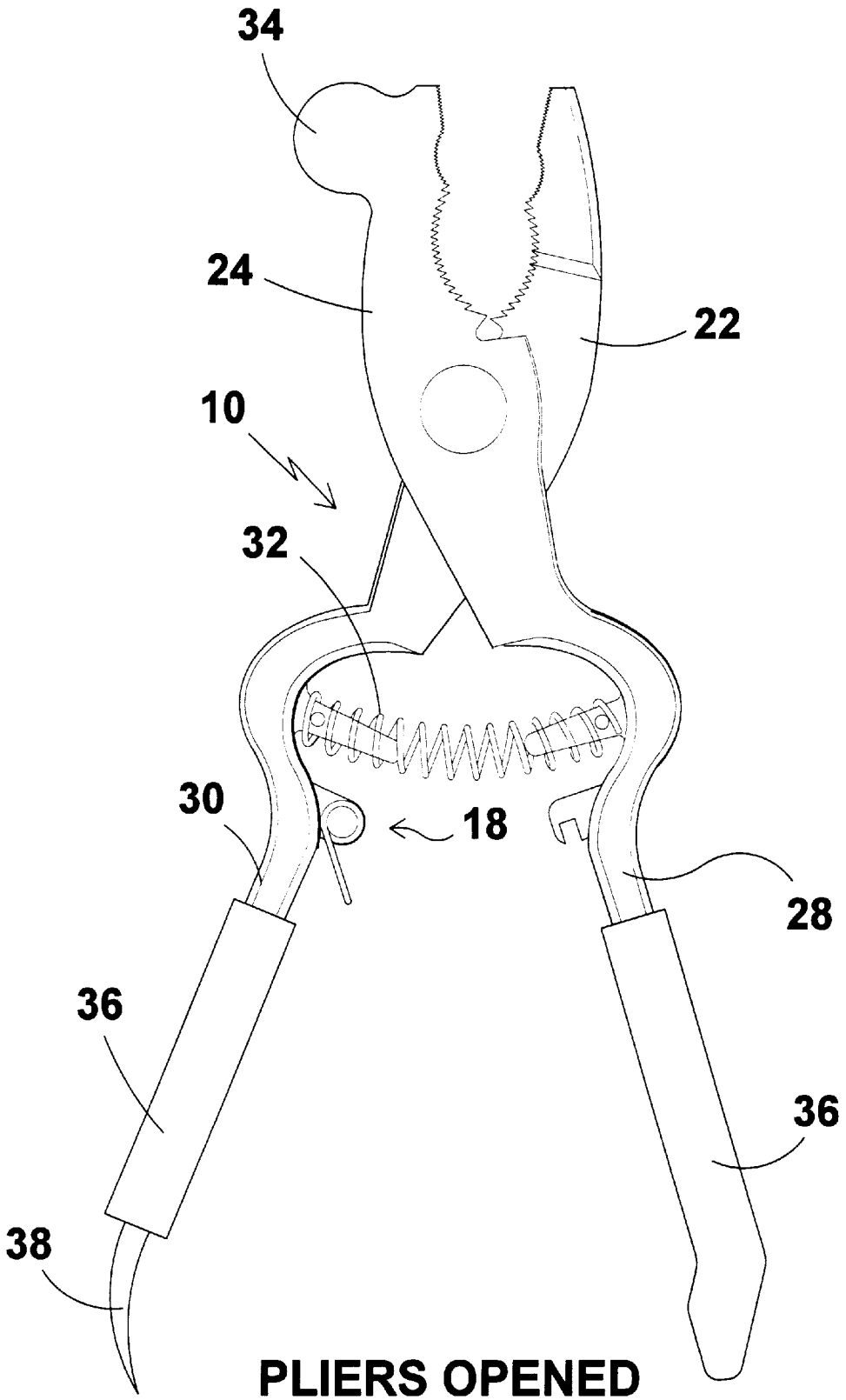
FIG. 4 is a plan view of said invention in the open position. The latch is shown open and the spring is liberated out. As the spring opens the plier handle the plier jaw also becomes open. Also illustrated is the solid leverage piece, for added leverage to finish pulling out nails after prying up with claw like device.

Turning to FIG. 4, shown therein is a plan view of the present invention 10 in the open position. The latch 18 is shown open and the spring 32 is expanded out. As the spring 32 opens the plier handles 28, 30 the plier jaws 22, 24 also become open. Also illustrated is the solid leverage piece 34, for added leverage to finish pulling out nails after prying up with claw like device 38.

Figure 5:
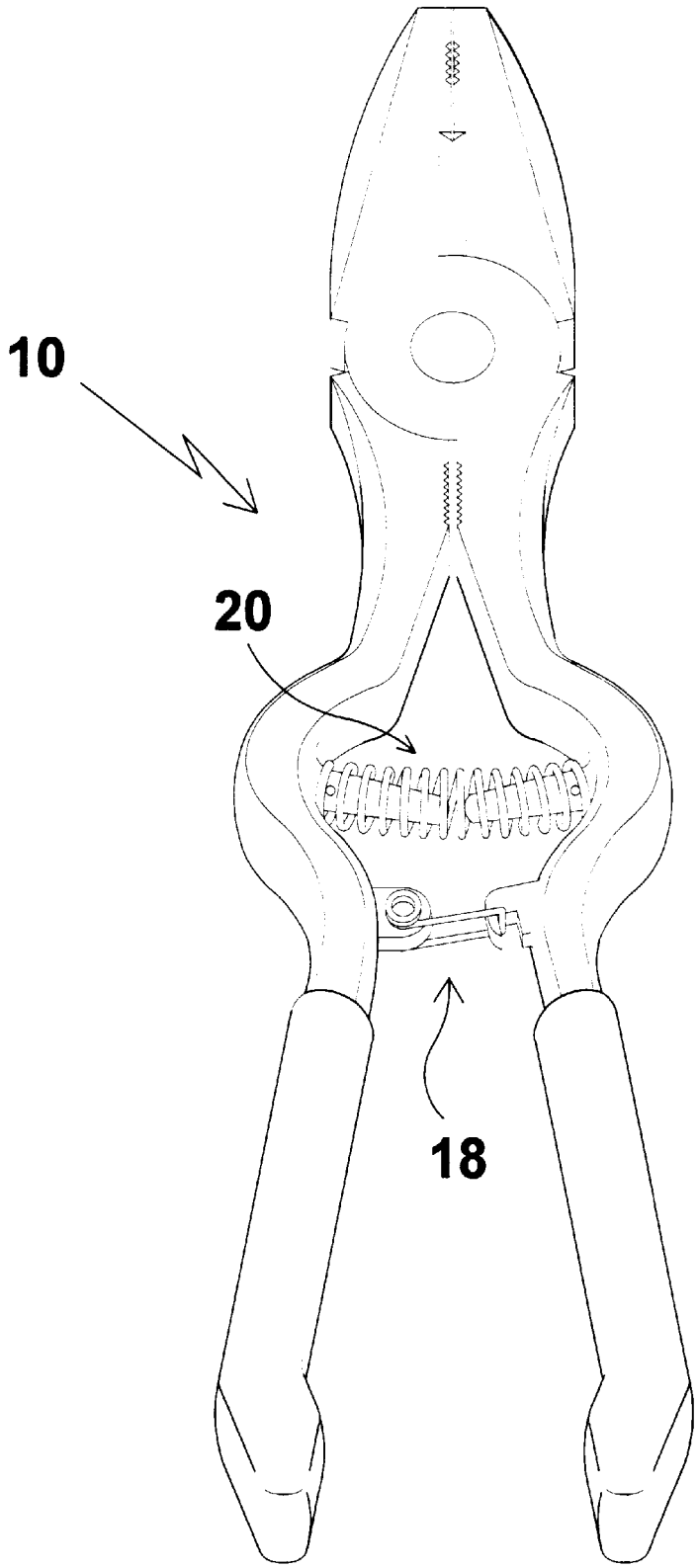
FIG. 5 is an illustration of the present invention depicting a pair of self opening combination linesman plier, with the self opening device. The self opening device is depicted in the lock position with spring system compressed.

Turning to FIG. 5, shown therein is an illustration of the present invention 10 depicting a pair of self-opening combination linesman pliers, with the self-opening device. The self-opening device is depicted in the locked position 18 with spring system 20 compressed.

Figure 6:
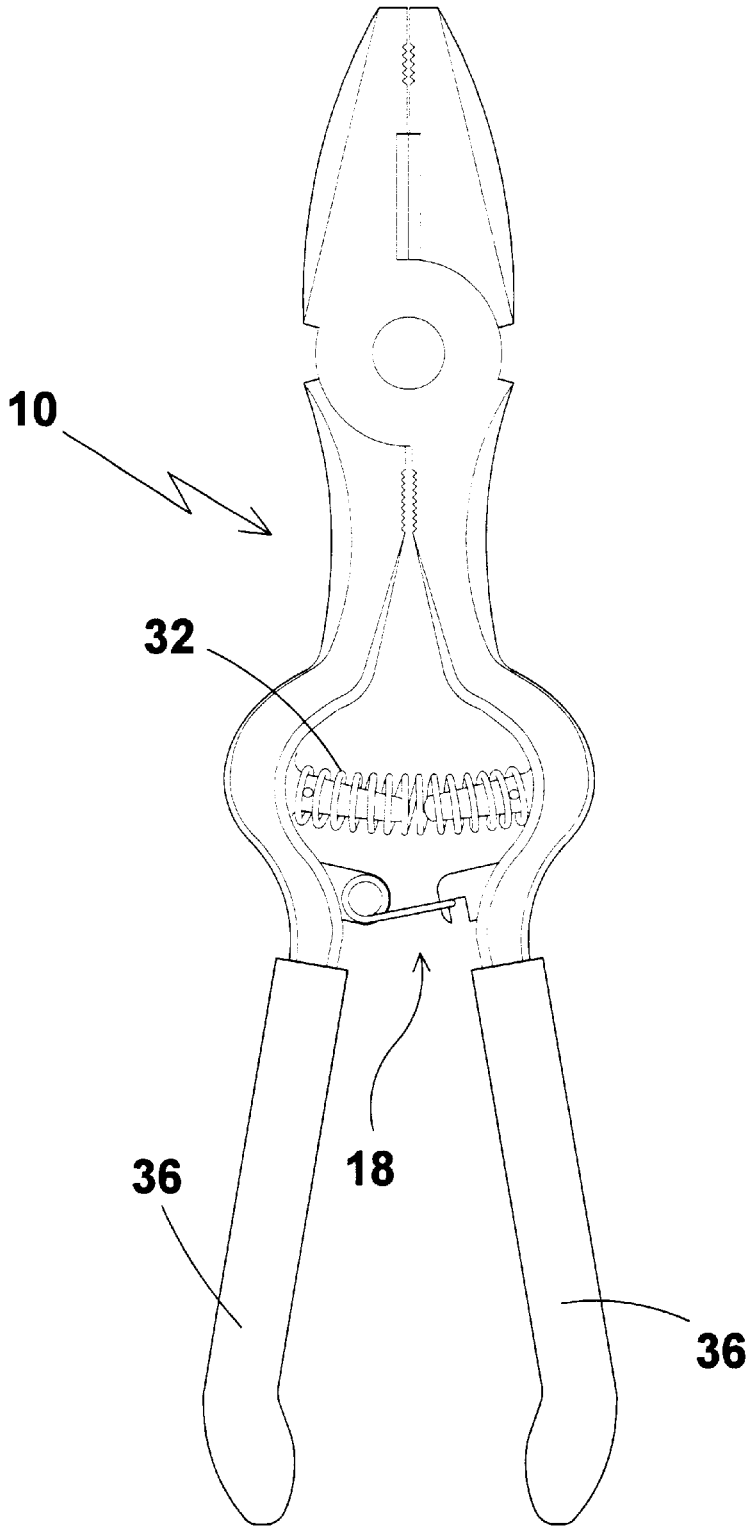
FIG. 6 is an orthographic view of said invention electrician linesman plier and cutter combination, shown in the closed position with the latch system in the lock position with spring compressed. Also illustrated is the rubber insulation jacket which covers both handles.

Turning to FIG. 6, shown therein is an orthographic view of the present invention 10 electrician linesman plier and cutter combination, shown in the closed position with the latch system 18 in the lock position with spring 32 compressed. Also illustrated is the rubber insulation jacket 36 which covers both handles.

Figure 7:
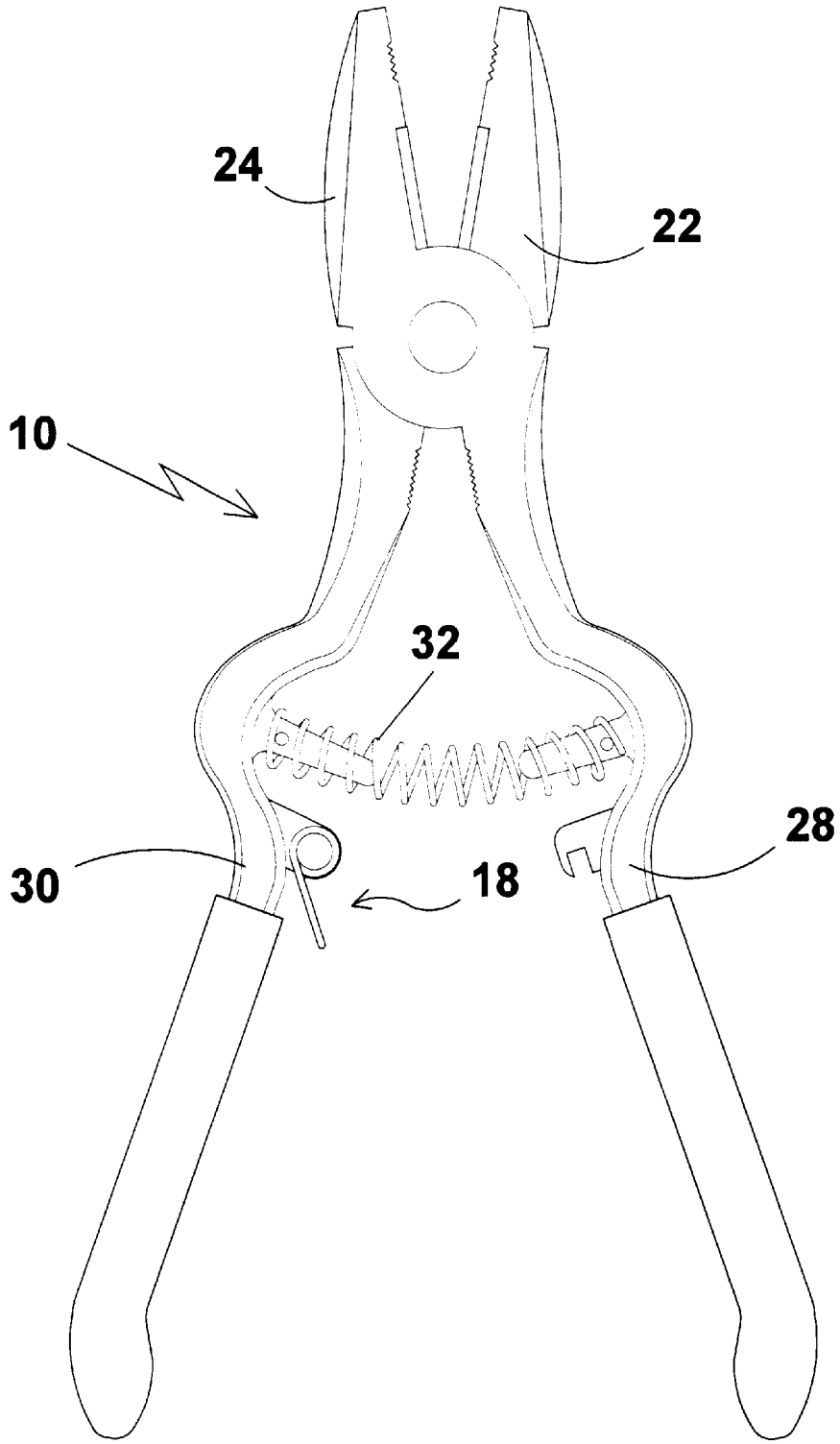
FIG. 7 is a plan view of the present invention showing linesman type pliers. The pliers are shown in the open position. The latch is shown open and the spring is liberated out. As the spring opens the plier handle and the plier jaws are forced open by the spring.

Turning to FIG. 7, shown therein is a plan view of the present invention 10 showing linesman type pliers. The pliers are shown in the open position. The latch 18 is shown open and the spring 32 is expanded out. As the spring 32 opens the plier handles, 28, 30 the plier jaws 22, 24 are forced open by the spring 32.

Figure 8:
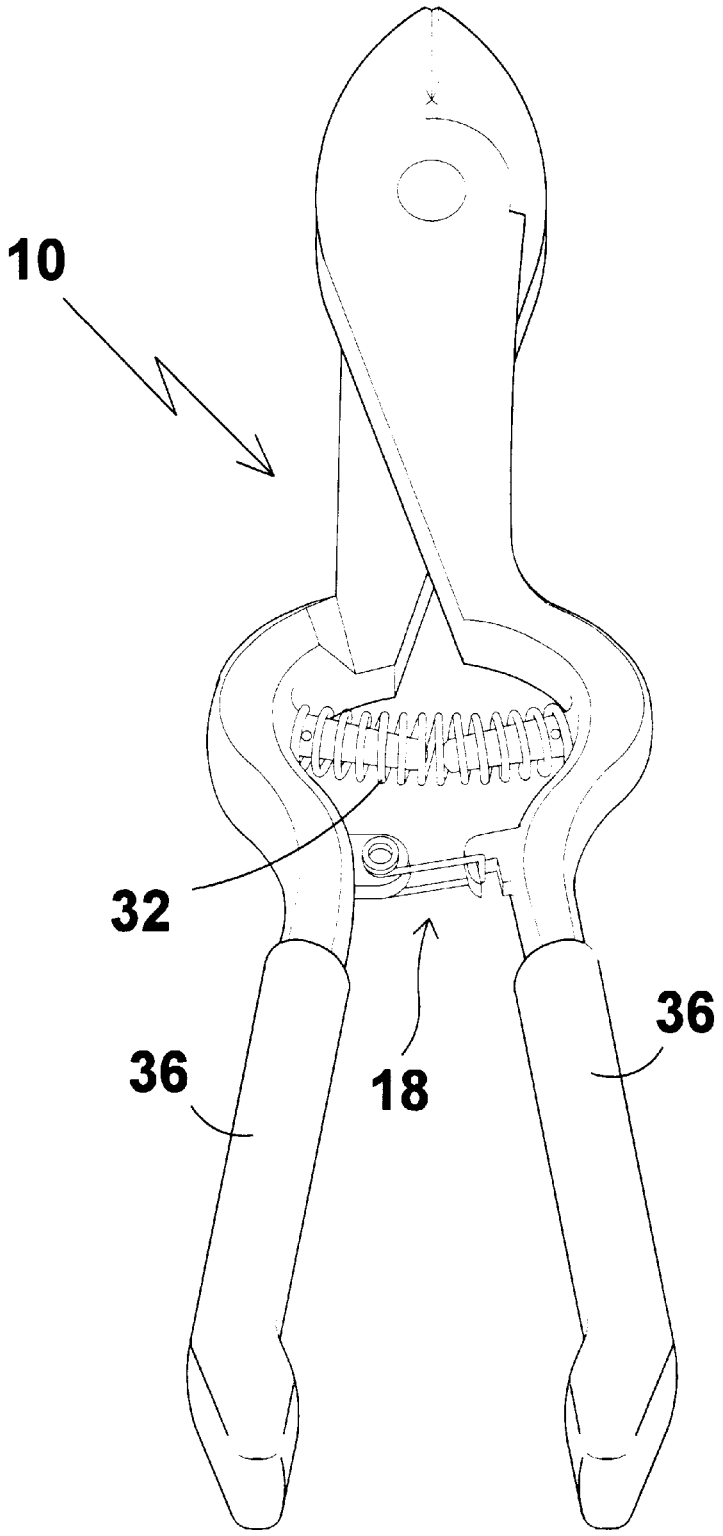
FIG. 8 is a perspective view of said invention, showing the self opening wire cutter, pliers in lock position. The spring is in a compressed position and the latch is also in the lock position. The handles are shown with a rubber like material jacket, to provide comfort to the hand and protect from possible electric contact.

Turning to FIG. 8, shown therein is a perspective view of the present invention 10, showing the self opening wire cutter, pliers in locked position. The spring 32 is in a compressed position and the latch 18 is also in the lock position. The handles are shown with a rubber like material jacket 36, to provide comfort to the hand and protect from possible electric contact.

Figure 9:
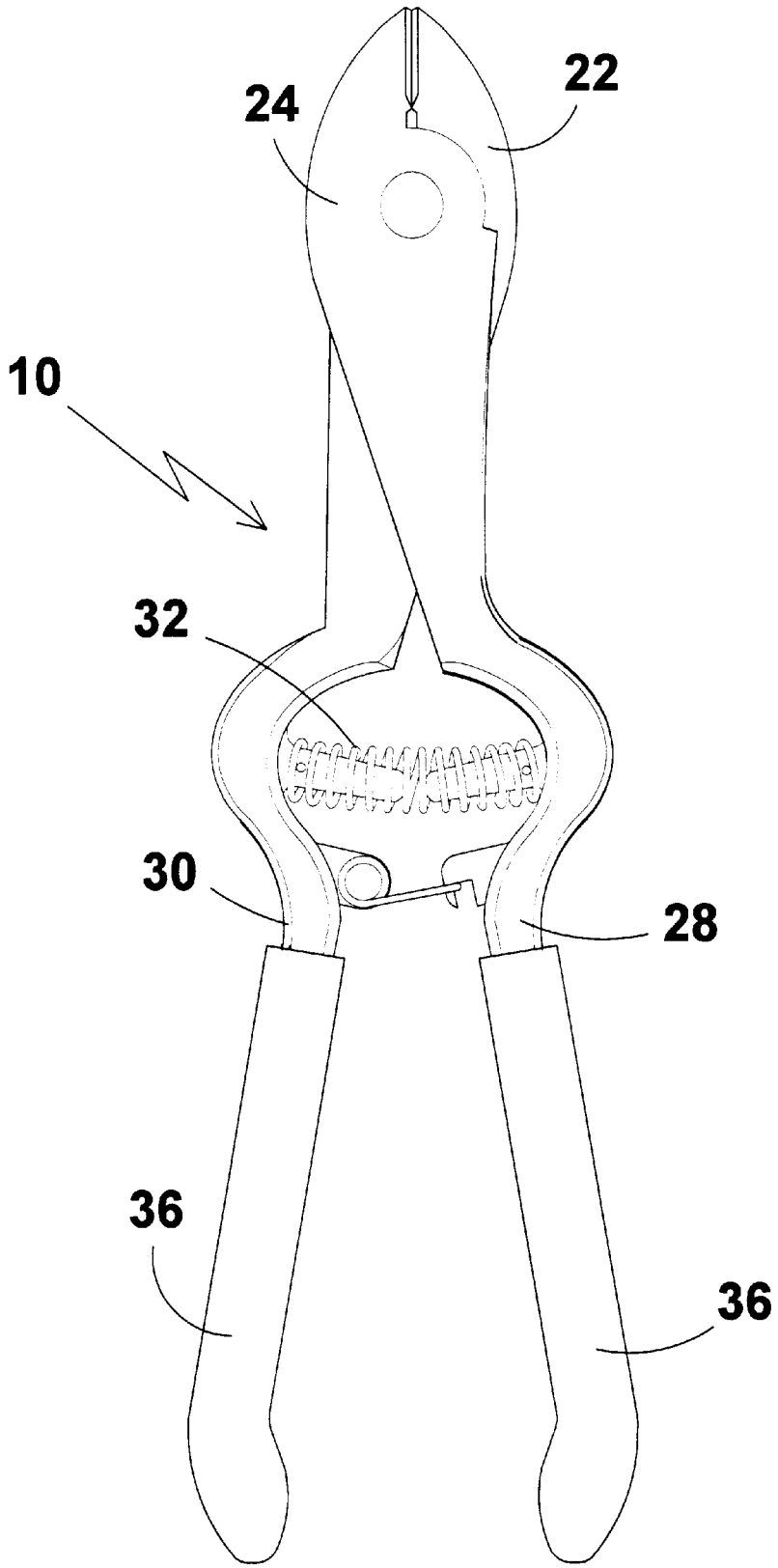
FIG. 9 is an orthographic view of said invention. The wire cutter pliers are shown in the lock position, showing the spring compressed and the plier jaw closed. Also shown are the rubber like material that jacket the two handles and provide comfort to the hands and provide insulation and protection from possible electric contact.

Turning to FIG. 9, shown therein is an orthographic view of the present invention 10. The wire cutter pliers are shown in the locked position, showing the spring 32 compressed and the plier jaws 22, 24 closed. Also shown are the rubber like material 36 that jacket the two handles 28, 30 and provide comfort to the hands and provide insulation and protection from possible electric contact.

Figure 10:
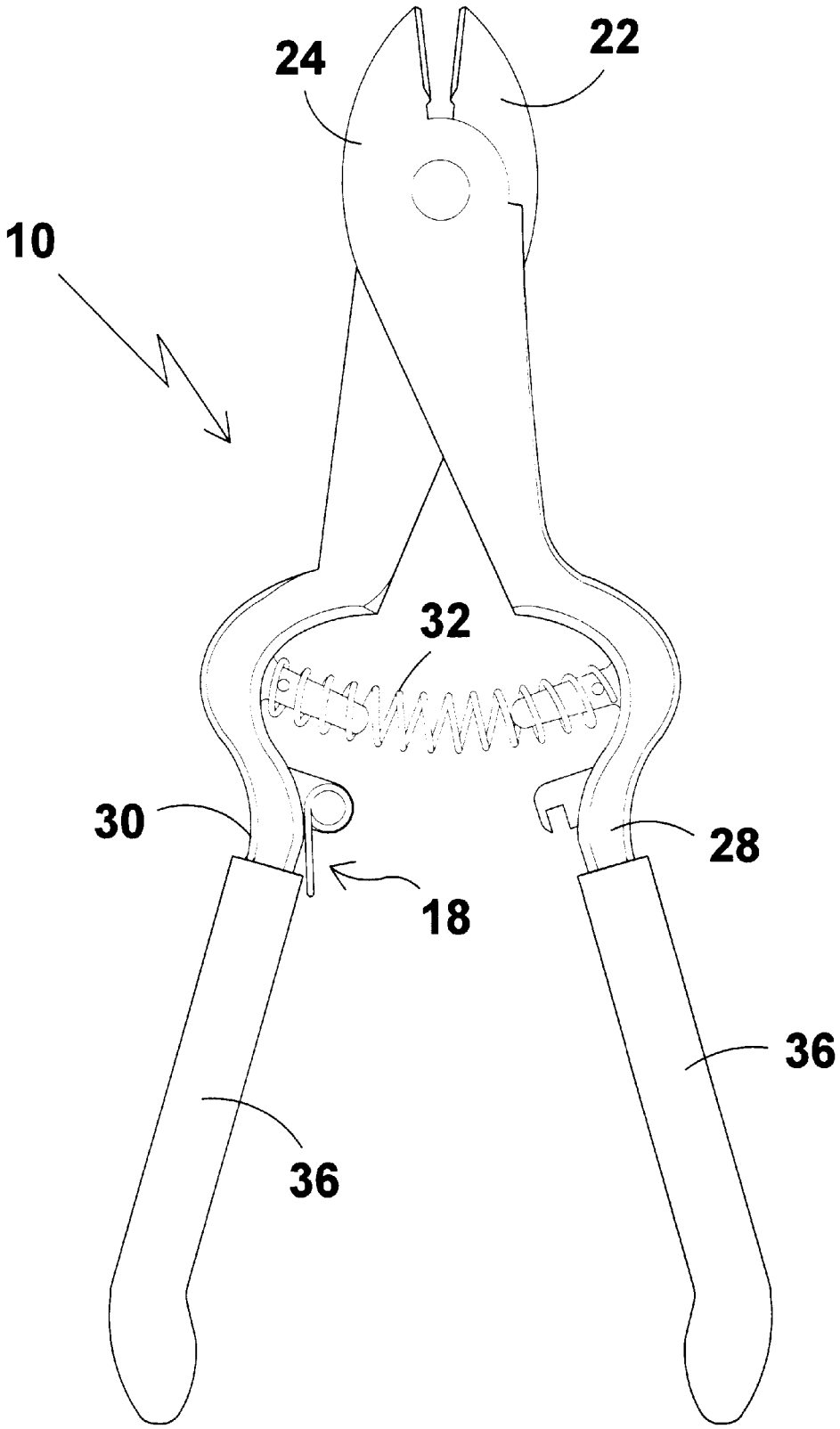
FIG. 10 is a plan view of the present invention in the open position. The latch is shown open and the spring is liberated out. As the latch is open the spring forces open the plier handles and the plier jaw. Also shown is the insulated jackets that cover both handles. The rubber like jacket provides comfort to the users hands and provides insulation to protect the user from possible electric contact.

Turning to FIG. 10, therein is shown is a plan view of the present invention 10 in the open position. The latch 18 is shown open and the spring 32 is expanded out. As the latch 18 is open the spring 32 forces open the plier handles 28 30 and the plier jaws 22, 24. Also shown is the insulated jackets 36 that cover both handles. The rubber like jacket 36 provides comfort to the users hands and provides insulation to protect the user from possible electric contact.

Figure 11:
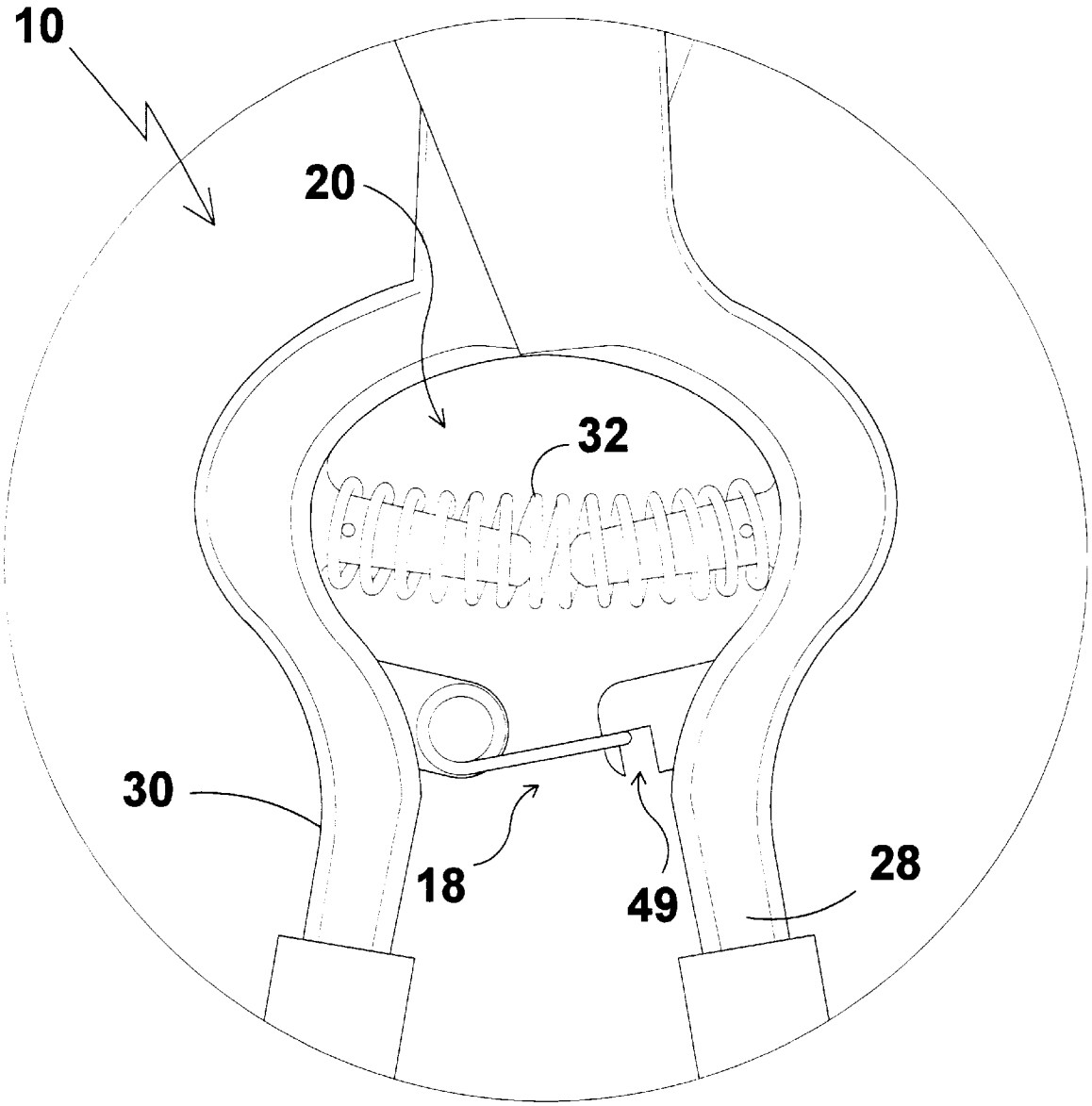
FIG. 11 is an orthographic section of said pliers, illustrating the spring mechanism and the latch system. As the latch is open, the spring pushes open the plier handles and opens the plier jaw. To lock the pliers closed, hand pressure is applied to the plier handles and squeezed closed and then the latch is also closed.

Turning to FIG. 11, shown therein is an orthographic section of the pliers of the present invention 10, illustrating the spring mechanism 20 and the latch system 18. As the latch 18 is opened, the spring 32 pushes open the plier handles 28, 30 and opens the plier jaws. To lock the pliers closed, hand pressure is applied to the plier handles 28, 30 and squeezed closed and then the latch 18 is also closed onto notch 49.

Figure 12:
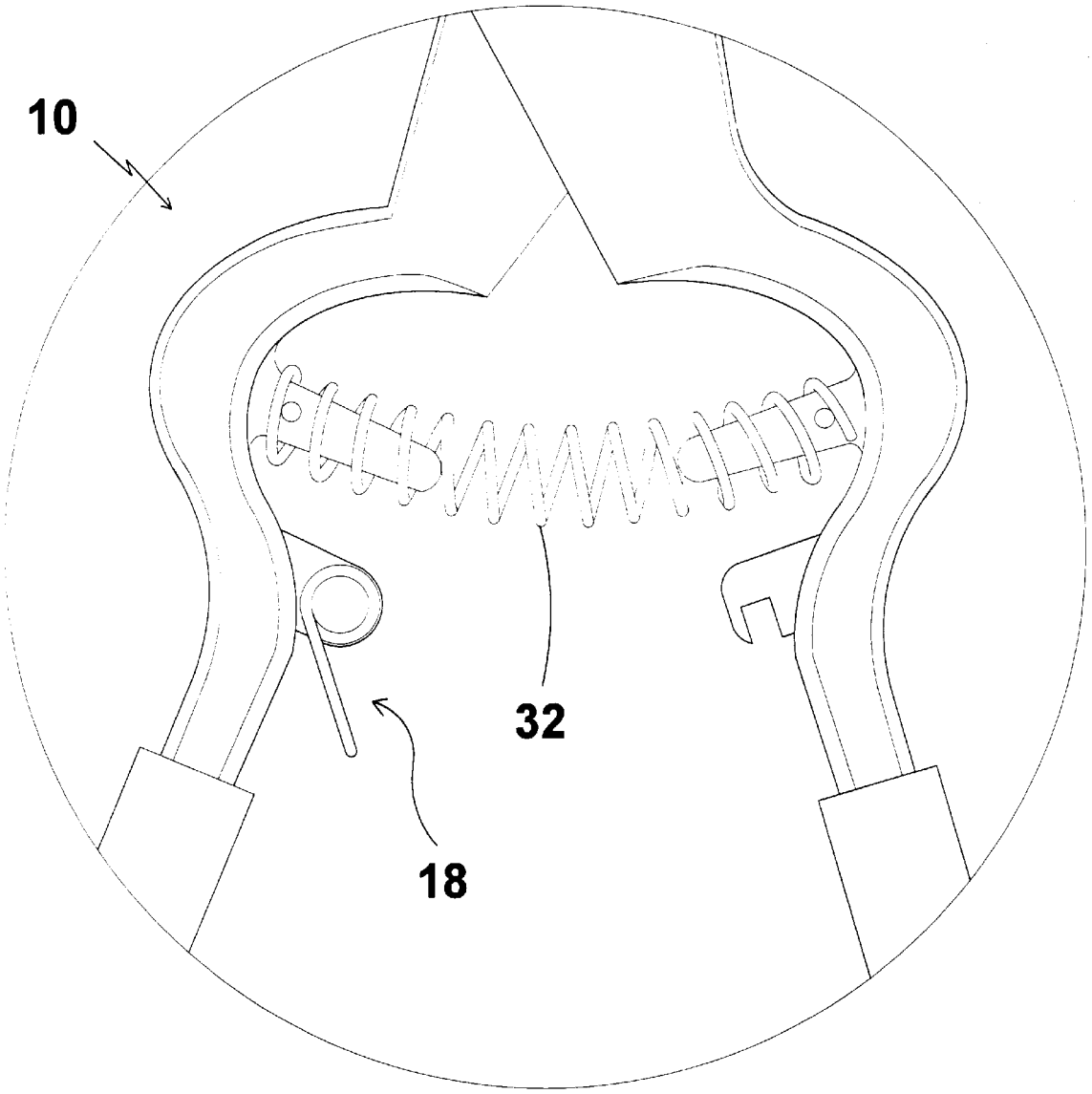
FIG. 12 is an orthographic sectional view of said invention depicting the pliers in an open position. The latch is open and the spring is liberated open.

Turning to FIG. 12, shown therein is an orthographic sectional view of the present invention 10 depicting the pliers in an open position. The latch 18 is open and the spring 32 is expanded open.

Figure 13:
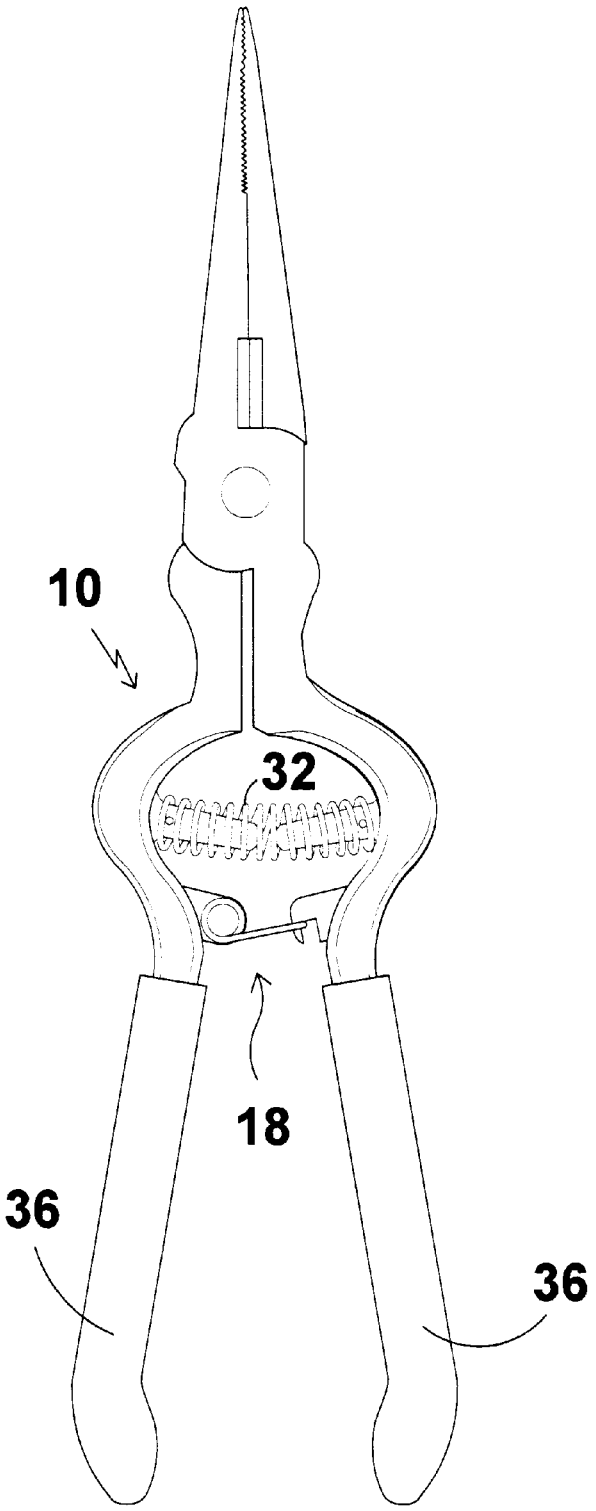
FIG. 13 is an orthographic view of said invention needle nose pliers and cutter combination, shown in the closed position with the latch system in the lock position with spring compressed. Also illustrated is the rubber insulation jacket which covers both handles.

Turning to FIG. 13, shown therein is an orthographic view of the present invention 10 needle nose pliers and cutter combination, shown in the closed position with the latch system 18 in the locked position with spring 32 compressed. Also illustrated is the rubber insulation jacket 36 which covers both handles.

Figure 14:
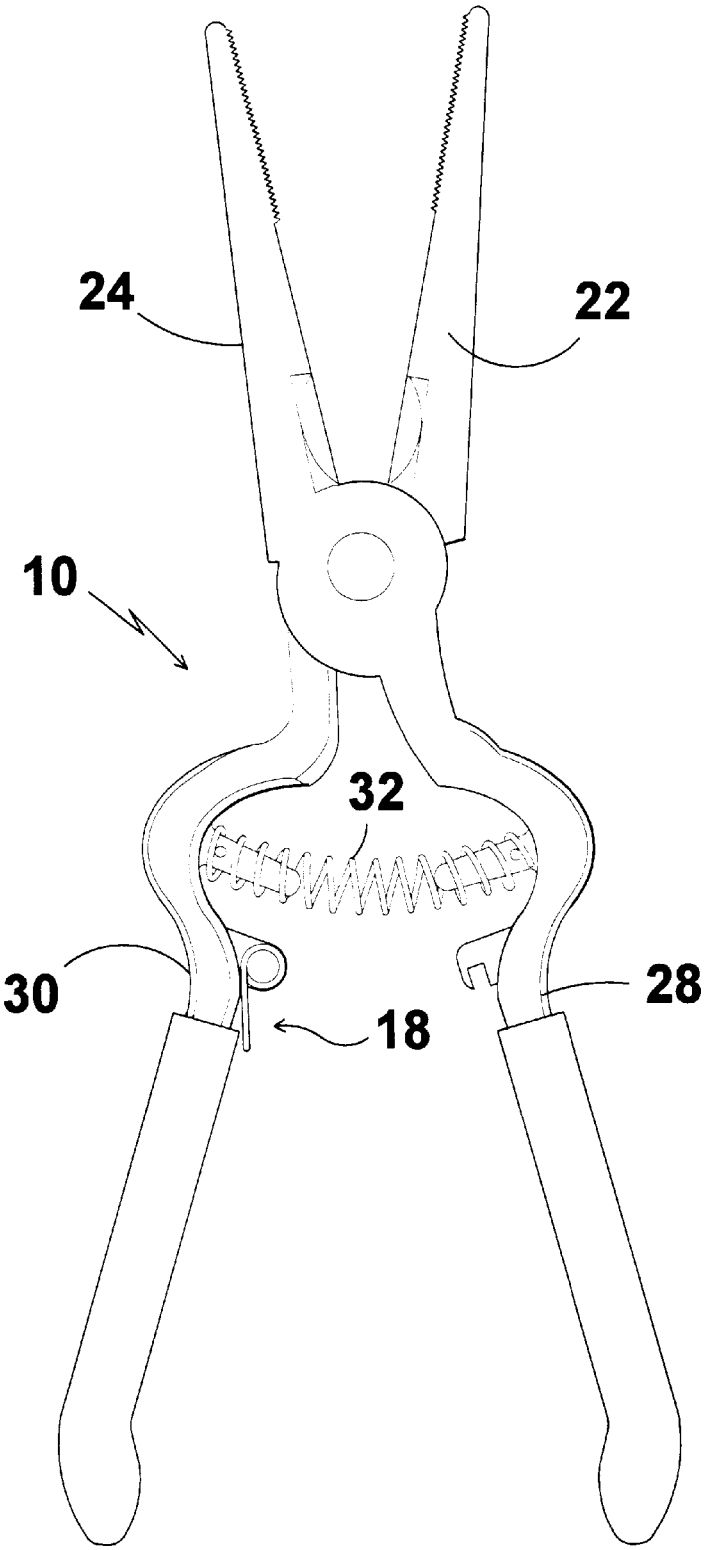
FIG. 14 is a plan view of the present invention showing needle node pliers. The pliers are shown in the open position. The latch is shown open and the spring is liberated out. As the spring opens the plier handle and the plier jaws are forced open by the spring.

Turning to FIG. 14, shown therein is a plan view of the present invention 10 showing needle nose pliers. The pliers are shown in the open position. The latch 18 is shown open and the spring 32 is expanded out. As the spring 32 opens the plier handles 28, 30 and the plier jaws 22, 24 are forced open by the spring 32.

What is claimed to be new and desired to be protected by Letters Patent is set forth in the appended claims.

I claim:

1. A set of pliers having a first and a second jaw and a first and second handle and a pivot point disposed above the first and second handle and between the first and second jaw and the first and second handle, the improvement comprising;

a) an outwardly curved portion on said first handle and said second handle;

b) said outwardly curved portion disposed below said pivot point;

c) a means for biasing outwardly said first handle from said second handle;

d) a means for locking said first handle and said second handle comprising a wire member on said first handle for connection to a notched member on said second handle;

e) each of said first and second jaws having flat surfaces facing each other and curved surfaces on the sides opposite the flat surfaces, and each of said first and second jaws having flat ends which are aligned when said first and second jaws are closed against each other; and f) the curved surface on said first jaw having a circular, solid leverage piece protruding therefrom and mounted adjacent the flat end of said first jaw with a circumference which is substantially tangentially aligned with the alignment of said flat ends of said first and second jaws to provide leverage when said first and second jaws are engaging a nail for removal thereof and pliers is rolled.

2. The apparatus of claim 1, said means for biasing further comprising a spring.

3. The apparatus of claim 1, said means for biasing further comprising a coiled spring.

* * * * *